United States Patent [19]

Gijzen et al.

[11] 4,014,425

[45] Mar. 29, 1977

[54] RECORDING ELEMENT FOR A MATRIX PRINTER

[75] Inventors: Wilhelmus Adrianus Henricus Gijzen; Theodorus Gerhardus Potma, Rijswijk, both of Netherlands

[73] Assignee: U.S. Philips Corporation, New York, N.Y.

[22] Filed: Nov. 20, 1975

[21] Appl. No.: 633,579

Related U.S. Application Data

[63] Continuation of Ser. No. 467,616, May 6, 1974, abandoned.

[30] Foreign Application Priority Data

May 30, 1973 Netherlands ..... 7307525

[52] U.S. Cl. ..... 197/1 R; 335/257; 335/274

[51] Int. Cl.[2] ..... B41J 3/04

[58] Field of Search ..... 197/1 R; 335/257, 274; 101/93.04, 93.05

[56] References Cited

UNITED STATES PATENTS

| | | | |
|---|---|---|---|
| 2,923,520 | 2/1960 | Ray | 335/257 |
| 3,665,353 | 5/1972 | Campbell | 335/274 X |
| 3,729,079 | 4/1973 | Zenner et al. | 197/1 R |
| 3,820,643 | 6/1974 | Priebs et al. | 197/1 R |
| 3,831,729 | 8/1974 | Howard | 197/1 R |

FOREIGN PATENTS OR APPLICATIONS

| | | | |
|---|---|---|---|
| 700,962 | 12/1964 | Canada | 335/257 |

*Primary Examiner*—Ralph T. Rader
*Attorney, Agent, or Firm*—Frank R. Trifari; Robert S. Smith

[57] ABSTRACT

A recording element for a matrix printer having an armature which is capable of movement relative to a casing under spring action by means of electric energization and to which a recording stylus is secured. The restoring spring surrounding the stylus is centered in the element in that its two end parts each comprise a plurality of closely wound turns. The spring part intermediate the end parts provides the spring action. Thus wear of the spring and the stylus due to rubbing contact is avoided.

4 Claims, 1 Drawing Figure

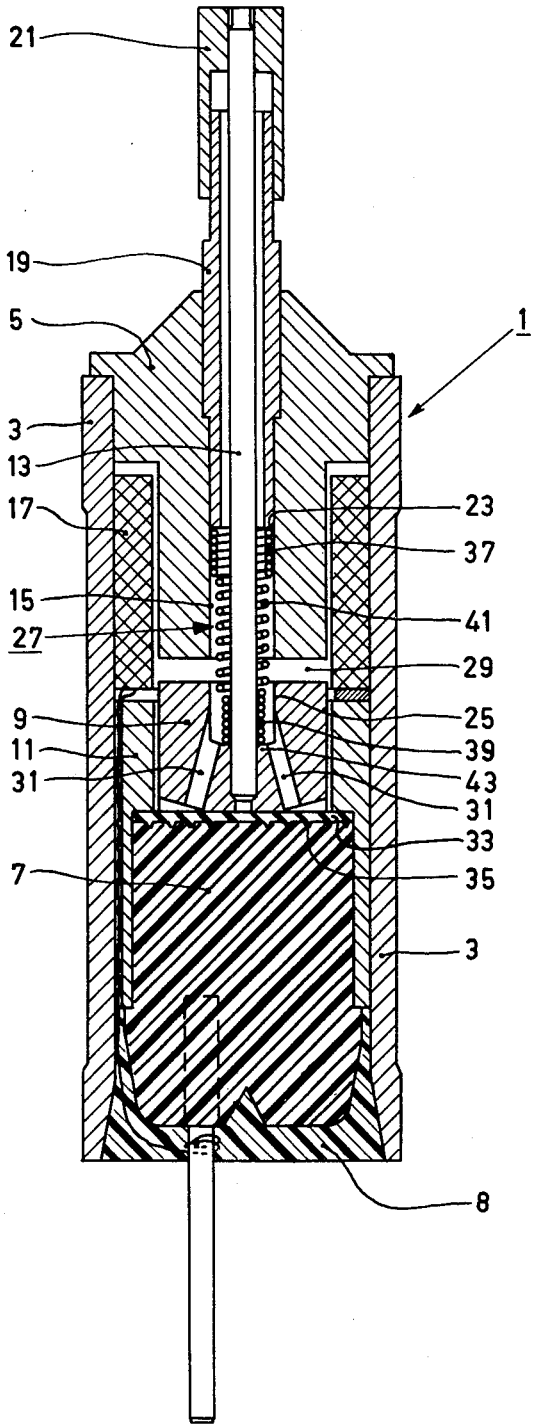
21
19
5
1
3
13
17
23
37
15
41
27
29
9
25
11
39
31
43
31
33
7
35
3
8

RECORDING ELEMENT FOR A MATRIX PRINTER

This is a continuation of application Ser. No. 467,616, filed May 6, 1974, now abandoned.

The invention relates to a recording element for a matrix printer having a casing in which an armature is guided which is movable with respect to the casing under spring action by means of electric energization and to which a recording stylus is secured, said spring action being produced by a restoring spring which is mounted between the movable armature and the casing and surrounds the recording stylus.

In known recording elements of the type referring to the restoring spring (helical spring) is centred by the recording stylus itself in that all, or substantially all, turns of the spring slidably surround the recording stylus. The pitch of such a spring has a constant value throughout the length of the spring. Compression or expansion of the spring causes movement of all the spring turns relative to one another and to the recording stylus. The spring is supported in its direction of length by contact surfaces which are formed on the armature and on the hole or bore provided in the casing of the recording element for its passage and which extend at right angles to the direction of length of the spring. The spring at each end engages the said surfaces with a part of the respective end turn.

A disadvantage of the aforedescribed known recording elements is that every translatory movement of the recording stylus gives rise to friction between the spring turns and the recording stylus, resulting in comparatively rapid wear of stylus and spring. Hence the spring in particular will have a short working life, because in matrix printers of the type referred to it is made of a thinner material than is the recording stylus. The wear will be greatest near the ends of the spring, because in these areas relative displacement of spring turns and stylus is greatest. In addition, this wear is not uniform for each of the plurality of recording elements used in a matrix printer, so that the spring constants of the various springs will become different. This gives rise to differences in impact force of the styli, resulting in differences in contrast between the individual dots or elements of the printed characters. This adversely affects the recognizability of the characters. The said disadvantages will also occur when the spring surrounds the stylus with a certain amount of clearance, in which case they are due to buckling. Buckling of the spring is directly due to the fact that the end of the spring is supported by the contact surfaces along part of the respective end turn only. This also results in that the admissible buckling force is less than when an end turn should be supported, for example, along an annular surface lying in a plane at right angles to the spring. Grinding of springs, especially small springs, to size is a difficult and expensive operation.

It is an object of the present invention to provide a recording element of the type referred to in which the said disadvantages are avoided.

For this purpose the invention is characterized in that the restoring spring which is mounted between the armature and the casing is centred near its ends with respect to the armature and the stylus by means of a number of comparatively fixedly and closely wound turns, while the spring part intermediate the ends comprises relatively movable turns which have an inner diameter greater than the diameter of the stylus and an outer diameter which causes the spring to remain clear of the parts of the recording element which surround the spring.

A particular embodiment of a recording element according to the invention is further characterized in that one end of the restoring spring closely engages the wall of a bore formed in the casing for the passage of the stylus whilst the other end of the restoring spring closely engages around the stylus, the former end part being supported by a shoulder formed in the respective bore and the latter end part being supported in a bore formed in the armature.

An embodiment of the invention will now be described, by way of example, with reference to the accompanying drawing the single FIGURE of which is a cross-sectional view of a recording element according to the invention.

Referring now to the FIGURE, a recording element has a casing 1 comprising a cylinder 3 which is closed at one end by a cylindrical bushing 5 and at the other end by an amount of an electrically insulating synthetic material 7, for example glass-reinforced nylon, which serves as an anvil, and a moulding resin 8. The cylinder 3 and the bushing 5 are made of a magnetically conducting material such, for example, as chromium steel. The casing 1 accommodates an armature 9 of a magnetically conductive material (chromium steel) which is slidably guided in a cylinder 11 which is also made of a magnetically conductive material (chromium steel) and the inner wall of which may be coated with Teflon to reduce friction. To the armature 9 is secured a recording stylus 13 of circular section which is made of a hard metal, for example tungsten, and is guided in a cylindrical bore 15 formed in the bushing 5. An electric energizing coil 17 is mounted between the bushing 5 and the cylinder 3. The bushing 5 surrounds a cylindrical support 19 for a cylindrical member 21 for guiding the recording stylus 13. The guide member 21 may for example be made of nitrided steel. The bushing 5, the support 19 and the guide member (bearing) 21 may alternatively be an integral unit. Between a shoulder 23 formed on the cylindrical support 19 and a cylindrical bore 25 formed in the armature 9 so as to be coaxial with the bore 15 a restoring spring 27 is enclosed which in the neutral position (in the non-energized condition of the coil 17) has a slight initial tension. When the coil 17 is not energized the armature 9 is in the position shown in the FIGURE, an air gap 29 being defined by the armature 9 and the bushing 5. The armature 9 is provided with two air ducts 31 which permits air present between the armature 9 and the bushing 5 to escape. To ensure satisfactory damping of the armature 9 there is provided between the armature 9 and the synthetic material 7 a layer of rubber 33 which when compressed can expand into grooves 35 formed in the synthetic material 7.

The restoring spring 27 in principle comprises three parts, two end parts 37 and 39 and an intermediate part 41, made in one piece from wire, for example Elgiloy or spring steel wire. The end parts 37 and 39 comprise twenty-one and fourteen turns respectively which are closely wound so as to be substantially incapable of relative movement and thus comparable to rigid tubes. Hence the end parts 37 and 39 cannot produce friction with respect to the bore 15 and the stylus 13. The member of such closely wound turns can experimentally be determined for each specific use. The minimum number is two full turns. The intermediate part 41 comprises a plurality of equal turns which are capable of relative movement and thus in effect cause the spring action and determine the spring constant. In the embodiment shown of a recording element according to the invention the turns in the end part 37 all have an outer diameter which is substantially equal (loose fit) to the inner diameter of the bore 15, while the turns in the end part 39 all have an inner diameter which is substantially equal (loose fit) to the diameter of the recording stylus 13. Consequently the end part 37 engages the wall of the bore 15 as closely as possible, and the end part 39 surrounds the stylus 13 as closely as possible. As a result the restoring spring 27 is completely centred with respect to the armature 9, the casing 1 and the stylus 13. The intermediate part 41 of the spring 27 — which comprises a plurality of turns which have an inner diameter greater than the diameter of the stylus 13 — provides no contribution to the centring of the spring, but itself is centred by the end parts 37 and 39. The outer diameter of the intermediate part is smaller than the diameters of the bores 15 and 25. In its direction of length the spring 27 at one end engages the annular shoulder 23 of the support 19 with a part of its end turn and at the other end it engages material 43 which serves as a shoulder and lies between the air ducts 31 in the armature 9. The armature 9 is moved by the coil 17 being energized. The magnetic flux which reduces the air gap 29 extends through the bushing 5, the air gap 29, the armature 9 and the cylinder 11.

By way of further illustration of the spring some of the most significant data thereof (in its neutral position) and of the stylus follow:

overall length of the spring: 8 mm
length of the end part 37: 3.5 mm
length of the end part 39: 1.5 mm
length of the intermediate part 41: 3 mm
number of turns of the intermediate part 41: 10
diameter of the recording stylus: 0.6 mm
clearance of intermediate part 41 around stylus: 0.2 mm. Because the two end parts 37 and 39 behave as excellently centred rigid tubes, movement of the armature cannot cause lateral deflection of the turns of the resilient intermediate part 41 so that frictional contact between the spring and the stylus and the bores 15 and 25 is avoided. As a result the useful lives of the spring and the stylus are greatly increased.

The principle of the invention described so far is not restricted to the embodiment shown in the FIGURE. For example, instead of an armature provided with a bore a solid armature may be used. In this case the end part of the spring closely surrounding the stylus lies outside instead of inside the armature. The bore 25 in the armature may also be replaced by an annular channel having an inner diameter greater than the stylus diameter. Alternatively the turns of the end part 39 may have an outer diameter which is equal to the diameter of the bore in the armature 9, so that this end part closely engages the bore wall instead of closely surrounding the stylus. It will be clear that the end part 37 also may be centred by an annular recess formed in the bushing 5 instead of by the wall of the bore 15. The intermediate part 41 of the spring may alternatively be conical.

Furthermore the use of the recording element described is not restricted to printers using the straight recording styli shown, but also extends to, for example, printers in which the styli project beyond the recording element along a partly curved path.

What is claimed is:

1. A recording element for a matrix printer which comprises a casing, a stylus carried for longitudinal motion with respect to said casing, a coil spring, having first and second ends, biasing said stylus in one direction, and means responsive to electric energization to bias said stylus in a direction opposite to said one direction, said spring being disposed around said stylus and within said casing, said coil spring having a plurality of turns at said first end disposed in axial abutting relationship in compressed and uncompressed modes of the entire spring and having means for preventing relative axial motion between said first end and said stylus, said means including the inside diameter of said plurality of coils of said first end being sized for sufficiently tight fitting engagement with said stylus to prevent relative axial movement between said stylus and said first end during operation of said recording element, said coil spring having an axial section intermediate said first end and said second end, said axial section having a plurality of coils disposed in axial spaced relation and having an inside diameter greater than the outside diameter of said stylus disposed within said axial section.

2. Apparatus as claimed in claim 1, wherein a plurality of said coils of said axial section have equal diameters.

3. Apparatus as claimed in claim 1 wherein said coils of said second end are disposed in axially abutting relationship in compressed and uncompressed modes of said axial section and having the outside diameter thereof sized for tight fitting engagement with said casing to prevent relative axial movement therebetween during operation of said recording element.

4. Apparatus as described in claim 3 wherein said casing has walls surrounding said axial portion of said spring, said walls being disposed in spaced relation to said axial portion of said spring.

* * * * *